US011891209B2

(12) United States Patent
Knutsen

(10) Patent No.: US 11,891,209 B2
(45) Date of Patent: Feb. 6, 2024

(54) PACKAGING SYSTEM COMPRISING A PLURALITY OF SUB UNITS, AND A SUB UNIT

(71) Applicant: Smart Packaging Industries Holding AS, Oslo (NO)

(72) Inventor: Stian Valentin Knutsen, Nesbru (NO)

(73) Assignee: Smart Packaging Industries Holding AS, Olso (NO)

( * ) Notice: Subject to any disclaimer, the term of this patent is extended or adjusted under 35 U.S.C. 154(b) by 0 days.

(21) Appl. No.: 16/067,233

(22) PCT Filed: Dec. 23, 2016

(86) PCT No.: PCT/NO2016/050268
§ 371 (c)(1),
(2) Date: Jun. 29, 2018

(87) PCT Pub. No.: WO2017/116236
PCT Pub. Date: Jul. 6, 2017

(65) Prior Publication Data

US 2019/0016497 A1 Jan. 17, 2019

Related U.S. Application Data

(63) Continuation of application No. 15/393,229, filed on Dec. 28, 2016, now abandoned.

(30) Foreign Application Priority Data

Dec. 29, 2015 (NO) ..... 20151802

(51) Int. Cl.
*B65D 21/02* (2006.01)
*B65D 1/30* (2006.01)
(Continued)

(52) U.S. Cl.
CPC ..... *B65D 1/30* (2013.01); *B65D 5/009* (2013.01); *B65D 21/0201* (2013.01);
(Continued)

(58) Field of Classification Search
CPC ..... B65D 1/30; B65D 5/009; B65D 21/0201; B65D 21/0206; B65D 25/04; B65D 77/20
(Continued)

(56) References Cited

U.S. PATENT DOCUMENTS 1,108,005 A 8/1914 Rey
2,151,066 A * 3/1939 Hutchison ..... G09B 23/04 434/403
(Continued)

FOREIGN PATENT DOCUMENTS

DE 1536138 A1 10/1969
DE 2923106 A1 12/1980
(Continued)

OTHER PUBLICATIONS

International Search Report (ISR) of the International Search Authority (ISA) dated Apr. 5, 2017 in related Application No. PCT/NO2016/050268 (published as WO 2017/116236 A1 on Jul. 6, 2017).
(Continued)

*Primary Examiner* — Steven A. Reynolds
(74) *Attorney, Agent, or Firm* — Hershkovitz & Associates, PLLC; Abe Hershkovitz

(57) ABSTRACT

A sub unit and a packaging system including a plurality of sub units. The sub unit is formed with a tapered body having sidewalls towards a narrow end from a first opposing or outer surface at an end opposite the narrow end. The packaging system includes a plurality of sub units, wherein the sub units are configured to be positioned so that the first opposing surfaces form an outside of the packaging system.

19 Claims, 11 Drawing Sheets

(51) Int. Cl.
*B65D 5/00* (2006.01)
*B65D 25/04* (2006.01)
*B65D 77/20* (2006.01)

(52) U.S. Cl.
CPC ..... *B65D 21/0206* (2013.01); *B65D 25/04* (2013.01); *B65D 77/20* (2013.01)

(58) Field of Classification Search
USPC ..... 220/23.83
See application file for complete search history.

(56) References Cited

U.S. PATENT DOCUMENTS

| | | | | | |
|---|---|---|---|---|---|
| 3,347,363 | A * | 10/1967 | Dykes | B65D 75/50 | 229/116 |
| 3,495,377 | A * | 2/1970 | Delme | B65B 5/08 | 53/142 |
| 4,605,159 | A * | 8/1986 | Harrel | B65D 77/042 | 229/116 |
| 4,799,590 | A * | 1/1989 | Furman | B65D 1/30 | 206/390 |
| 5,007,540 | A | 4/1991 | Beasley et al. | | |
| 5,115,916 | A | 5/1992 | Beasley | | |
| 6,431,361 | B1 * | 8/2002 | Wolf | B65D 81/052 | 206/522 |
| 7,686,162 | B2 * | 3/2010 | Fath | B65D 85/1072 | 206/264 |
| 7,913,847 | B2 * | 3/2011 | Kasboske | B65D 81/052 | 206/522 |
| 8,074,801 | B2 * | 12/2011 | Slayton | A61F 13/5519 | 206/440 |
| 8,695,848 | B2 * | 4/2014 | Cook | B65D 83/0847 | 206/436 |
| 9,199,767 | B1 * | 12/2015 | Pheir | B65D 11/00 | |
| 10,421,562 | B2 * | 9/2019 | Skarin | B65B 65/003 | |
| 2005/0000976 | A1 * | 1/2005 | Keberlein | B65D 5/70 | 221/63 |
| 2006/0210676 | A1 * | 9/2006 | Knebl | B65D 21/0204 | 426/106 |
| 2008/0251408 | A1 | 10/2008 | Kasboske | | |
| 2013/0206772 | A1 * | 8/2013 | Halbherr | A47L 15/4445 | 220/507 |

FOREIGN PATENT DOCUMENTS

| | | | | |
|---|---|---|---|---|
| DE | 20312280 | U1 | 11/2003 | |
| EP | 0279488 | A1 | 8/1988 | |
| EP | 1746031 | A1 * | 1/2007 | B65D 1/30 |
| EP | 1746031 | A1 | 1/2007 | |
| EP | 1746031 | B1 | 9/2009 | |
| FR | 2050532 | A5 | 4/1971 | |
| FR | 2882989 | A1 | 9/2006 | |
| JP | S 5717972 | U | 1/1982 | |
| JP | H02-71707 | A | 3/1990 | |
| JP | H09-240733 | A | 9/1997 | |
| JP | 3090405 | U | 12/2002 | |
| JP | 2006-044687 | A | 2/2006 | |
| JP | 3122920 | U | 6/2006 | |
| JP | 2010202216 | A | 9/2010 | |
| WO | WO 8909734 | A1 | 10/1989 | |
| WO | WO 2010040153 | A1 | 4/2010 | |
| WO | WO 2010060613 | A1 | 6/2010 | |

OTHER PUBLICATIONS

Chapter II International Preliminary Report on Patentability (IPRP) of the International Preliminary Examining Authority (IPEA) dated May 4, 2018 in related Application No. PCT/NO2016/050268 (published as WO 2017/116236 A1 on Jul. 6, 2017).
Abstract of DE 2923106 A1.
Abstract of DE 1536138 A1.
Partial Mechanical Translation of DE 1536138 A1 from Google Translate.
Extended European Search Report dated Jul. 9, 2019 in related European Application No. EP 16 88 2172.
Office Action dated Jul. 15, 2019 in related Russian Application No. 2018125442/12(040257).
English language Abstract of JP 2006-044687 A (Feb. 16, 2006).
English language Abstract of JP H09-240733 A (Sep. 16, 1997).
English translation of the Office Action in related Japanese Application No. 2018-554304, dated Sep. 7, 2020, with additional information regarding relevance of the cited references.
English Language Machine Translation of a portion of JP 2010202216 A.
English Language Machine Translation of a portion of JP S 5717972 U.
JP Office Action in JP Application No. 2018-554304 dated Feb. 25, 2021 and English Language Machine Translation.
English language Abstract of JP H02-71707 A (Mar. 12, 1990).
English translation of the Office Action in related Japanese Application No. 2018-554304, dated Sep. 21, 2021.
English machine translation of JP 3090405 U (Dec. 13, 2002).
English machine translation of JP 3122920 U (Jun. 29, 2006).
Office Action in corresponding Chinese Application No. 201680080989.9, dated May 24, 2023.
English machine translation of the Office Action in corresponding Chinese Application No. 201680080989.9, dated May 24, 2023.

* cited by examiner

PACKAGING SYSTEM COMPRISING A PLURALITY OF SUB UNITS, AND A SUB UNIT

FIELD

The present invention relates to a packaging system and a sub unit for packaging using said packaging system.

BACKGROUND OF THE INVENTION

Disclosure of the State of Art

Many types of products are packaged for many simultaneous reasons such as technical requirements relating to safety, hygiene and portions while also for aesthetics and convenience. At the same time it is important to make sure the packages are compact and sturdy, particularly for transport.

Many packages today satisfy only a few of these aspects. For instance many packages are cylindrical leaving much space between packages when stacked together. Tapered structures are also known such sections of as pyramids or cones, typically having a frustum. Also these contribute to the problem of unused space.

From prior art one should refer to DE20312280 which describes a multi chamber tetrahedral packaging system.

One should also refer to DE2923106 which describes package for tablets made of plastic foil with deep drawn spaces for each individual tablet in a parallel on-edge arrangement. Each deep drawn space has tapering sides both on the narrow ends for easy removal and on the wide ends. The latter is done so that packages can be assembled in comb fashion and packed together in a small carton.

Also one should refer to EP0279488 which describes elements that are hingeably connected together to form a continuous row of elements.

Also one should refer to FR2882989 which describes sub units that can be folded to form boxes.

Reference should also be made to DE1536138 which describes multiple containers of a polygonal shape.

One should also refer to FR2050532 which describes a multi chamber packaging system based on prism or trapezoidal sub units.

Also one should refer to WO2010/060613 which describes a container comprising a tray defining a plurality of receptacles.

Furthermore one should refer to WO89/09734 which describes a generally cylindrical casing for storing and protecting objects.

Reference should also be made to U.S. Pat. No. 4,799,590 describing sub units folded into cylinders that can be assembled into columns.

Moreover one should refer to U.S. Pat. No. 1,108,005 which describes a multi cellular cylindrical package.

Moreover one should refer to U.S. Pat. No. 5,115,916 which describes a package comprising a plurality of separate containers in the form of triangular truncated wedges.

Finally one should refer to WO2010/040153 which describes a container for liquids that can be assembled with like containers in to a ball shape.

OBJECTS OF THE PRESENT INVENTION

Summary of the Invention

The packaging system according to the present invention is characterised in that it comprises a plurality of sub units having a tapered structure towards a narrow end from a first opposing surface at an end opposite the narrow end, wherein the sub units are configured to be positioned so that the first opposing surfaces form an outside of the packaging system.

The present invention also comprises a sub unit for assembling into a packaging system according to the above packaging system, wherein said sub unit is formed with a tapered body having sidewalls towards a narrow end from a first opposing or outer surface at an end opposite the narrow end.

One typical packaging system of the present invention comprises 6 sub units arranged with each of their narrow ends towards the centre of the packaging system and their respective opposing surfaces towards the outer surface of the packaging system. This packaging system thus constitutes a rectangular parallelepiped, preferably a cube. Although such a cube of 6 sub units constitutes a feasible system, a larger number of sub units may constitute a system of the present invention.

A number of cubes may further be assembled to constitute a collection of cubes.

A problem to be Solved by the invention is to utilize dead volume in packaging systems of today.

Another problem to be solved by the invention is inherent support of fragile walls. The walls, including openings, of said sub unit may be fragile. The design of the sub units enables a substantial part of their walls to mutually support each other force wise when stacked together 6 in a cube and further on when stacking multiples of cubes next to each.

When stacking together systems of rectangular parallelepipeds, e.g. cubes, into a collection of parallelepipeds, e.g. collection of cubes, the outer boundaries of the collection may be positioned adjacent the inner walls of a housing.

Therefore, a main objective of the present invention is to provide a packaging system and a packaging collection that is compact and sturdy.

Means for Solving the Problems

The objective is achieved according to the invention by a packaging system as defined in the preamble of claim 1, having the features of the characterising portion of claim 1, and a sub unit for packaging using said packaging system as defined in the preamble of claim 2, having the features of the characterising portion of claim 2.

A number of non-exhaustive embodiments, variants or alternatives of the invention are defined by the dependent claims.

The present invention attains the above-described objective by sub units having a tapered structure towards a narrow end from a first opposing surface at an end opposite the narrow end, so that a plurality of said sub units can be assembled to a package unit.

Effects of the Invention

The technical differences over prior art is that stacking is not by layers but by forming package units by positioning sub units so that the narrow end points towards the centre of the assembled package unit.

These effects provide in turn several further advantageous effects:

- it makes it possible to form ready packages comprising sub packages for use cases where different contents is required it makes it possible to form cubic packages that can be more easily stacked and unloaded than individual sub packages.

DESCRIPTION OF THE DIAGRAMS

Embodiments of the present invention will now be described, by way of example only, with reference to the following diagrams wherein.

Figure 3A:
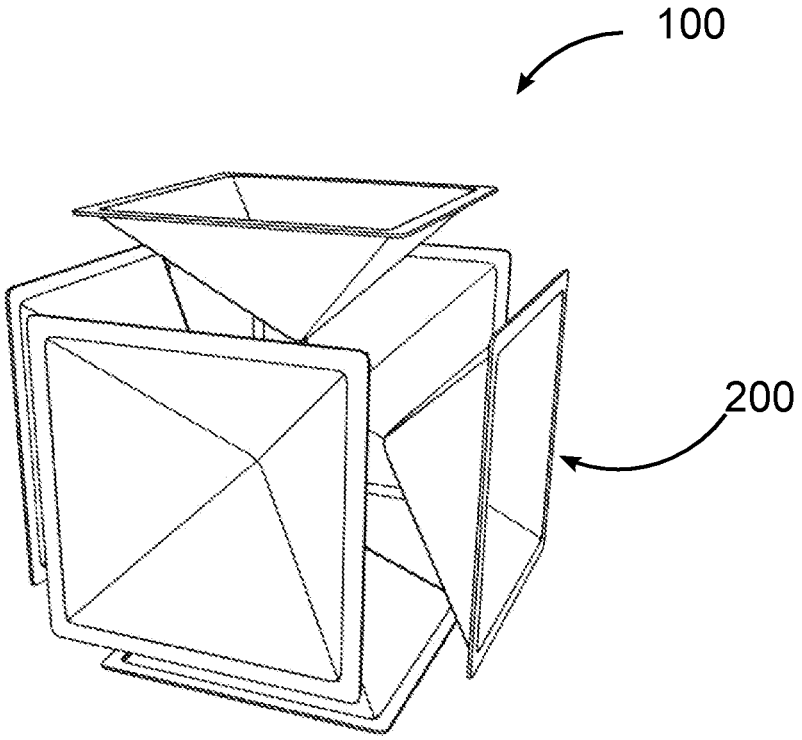
FIG. 3A shows a preassembled collection of a first embodiment of sub unit
Figure 3B:
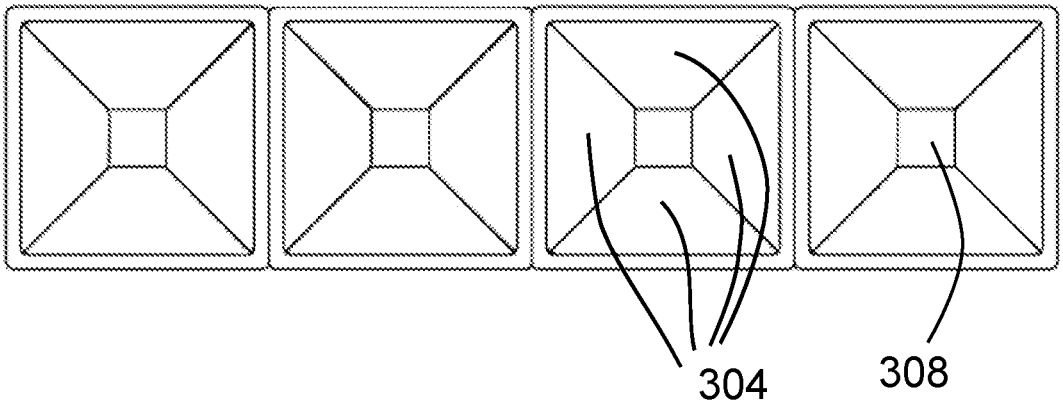
FIG. 3B shows a preassembled collection of a second embodiment of sub unit
Figure 3C:
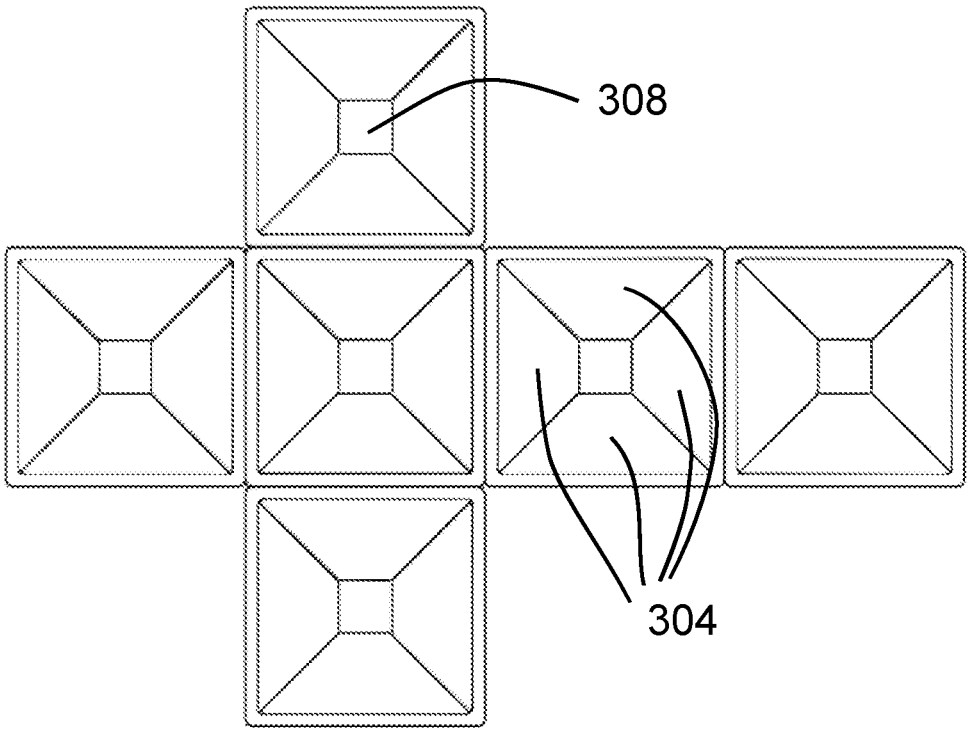
Figure 3D:
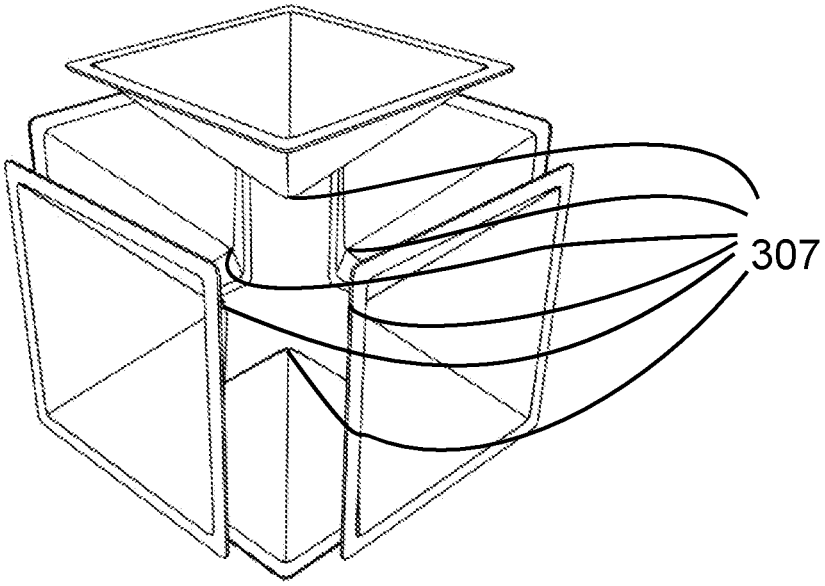
Figure 4A:
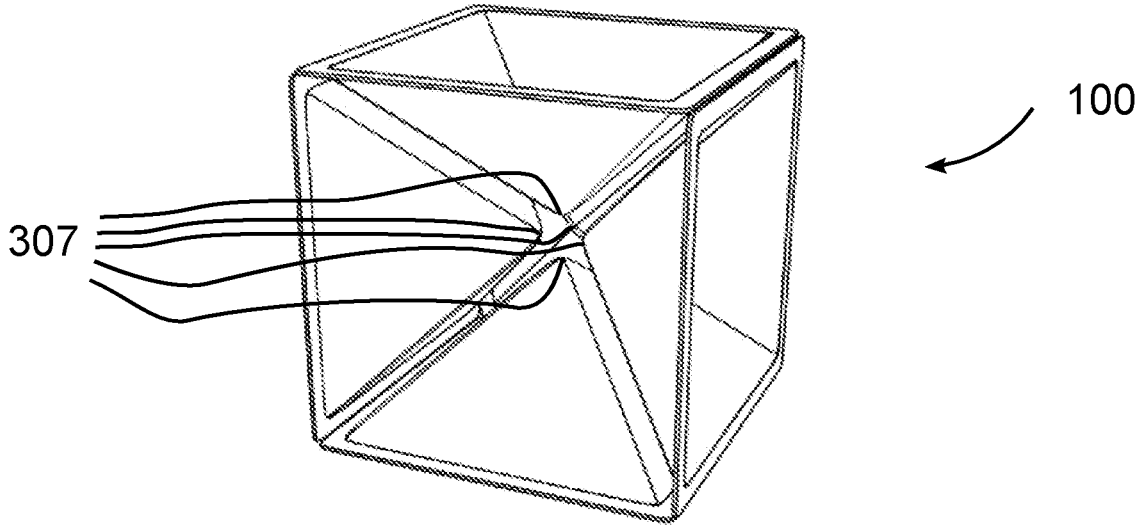
Figure 4B:
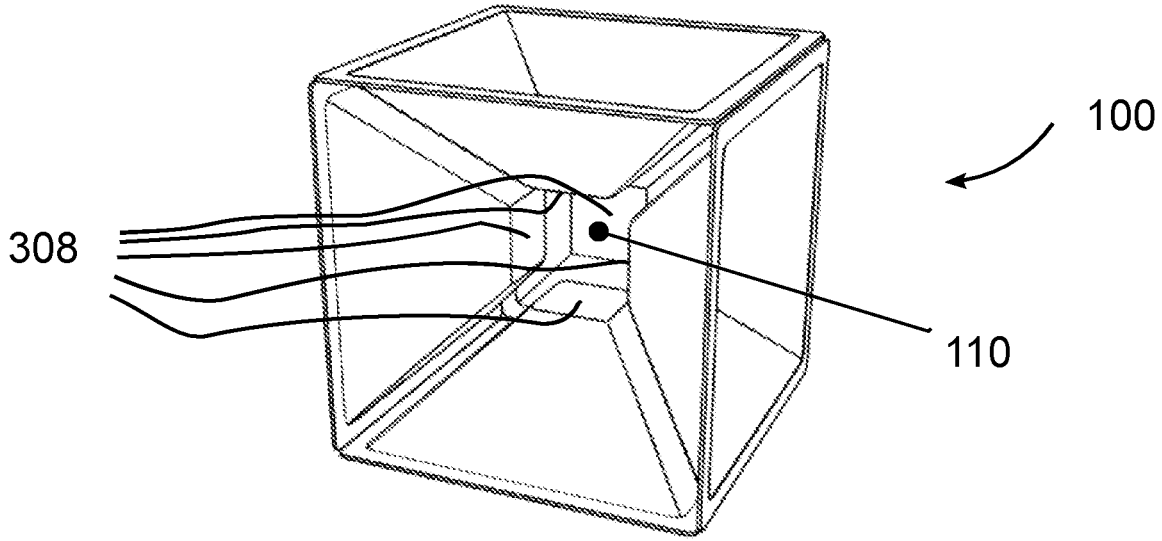
Figure 5:
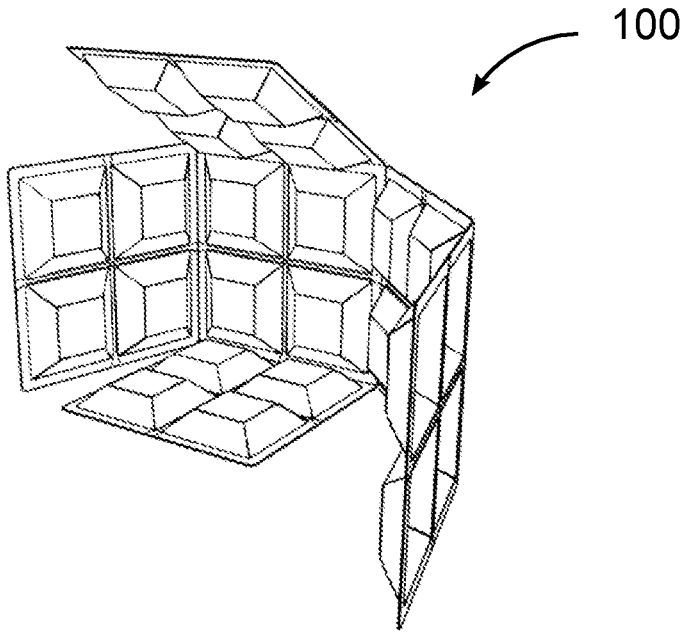
Figure 6:
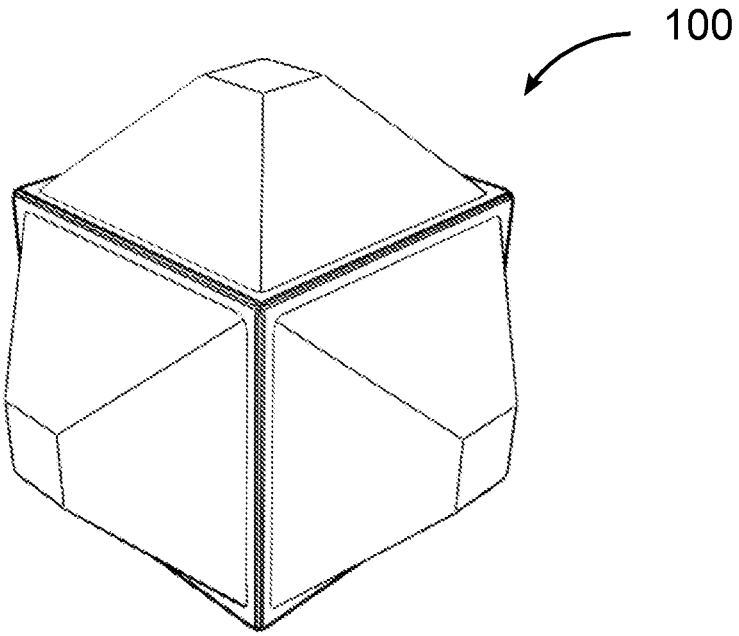
Figure 7A:
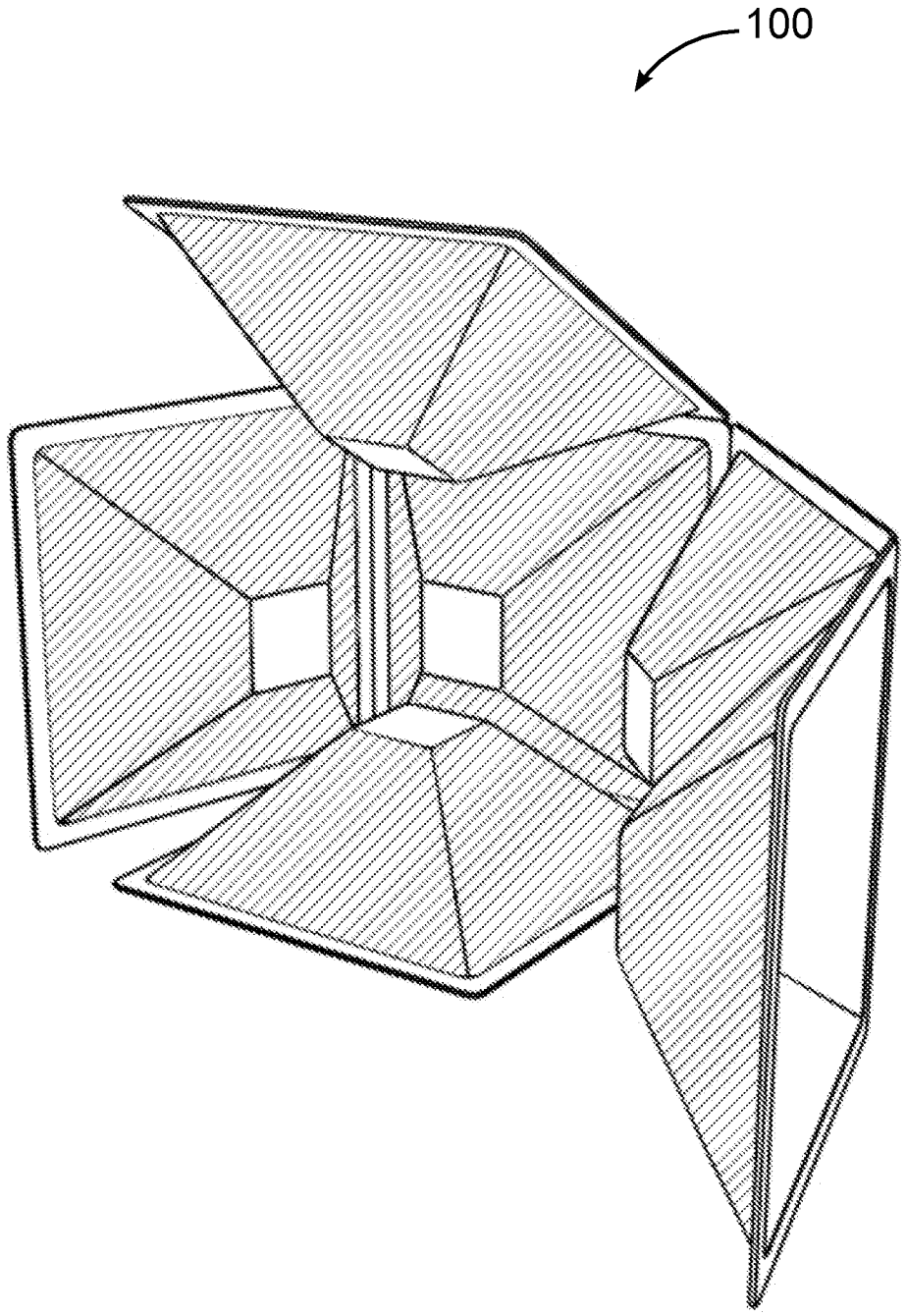
Figure 7B:
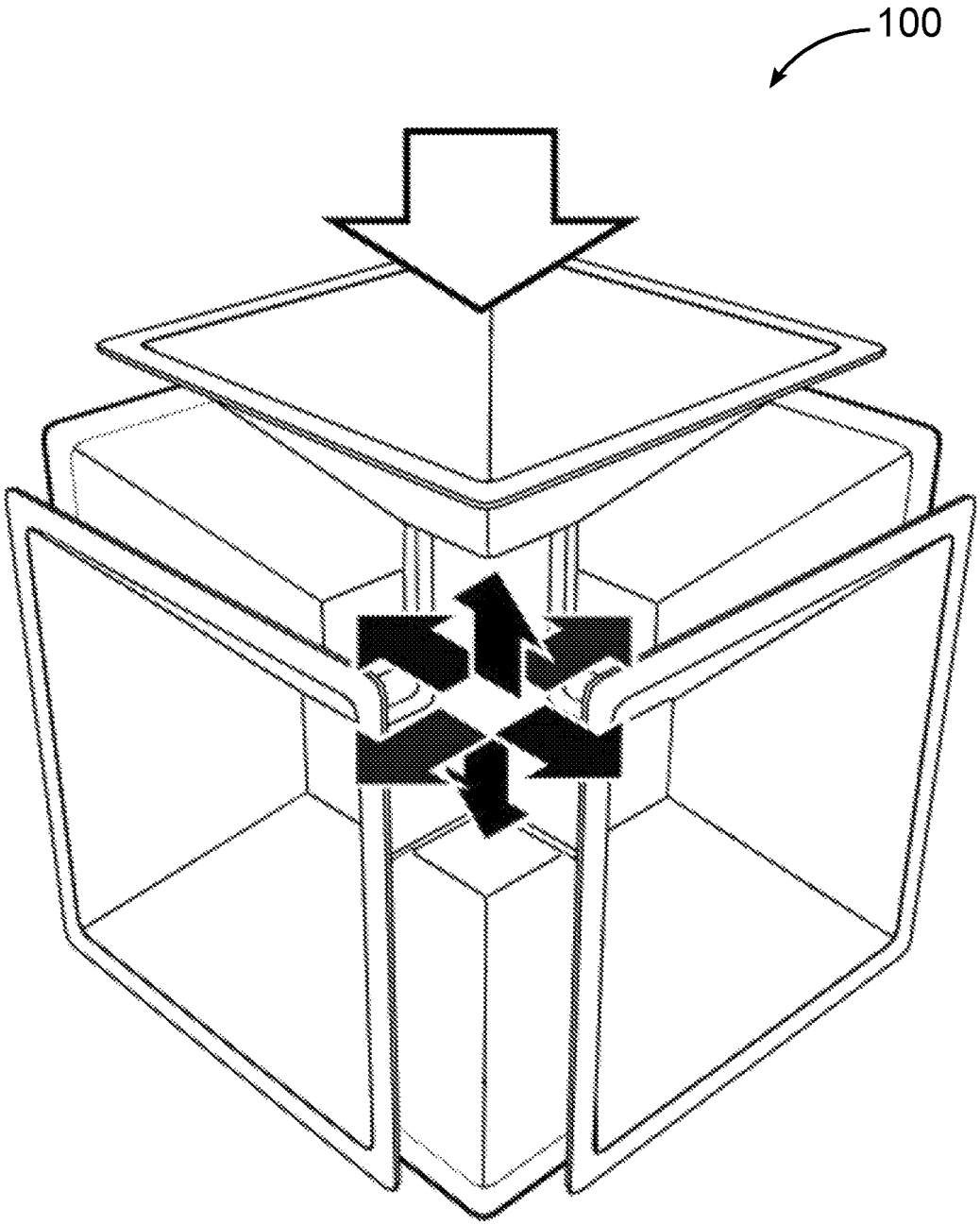
Figure 7C:
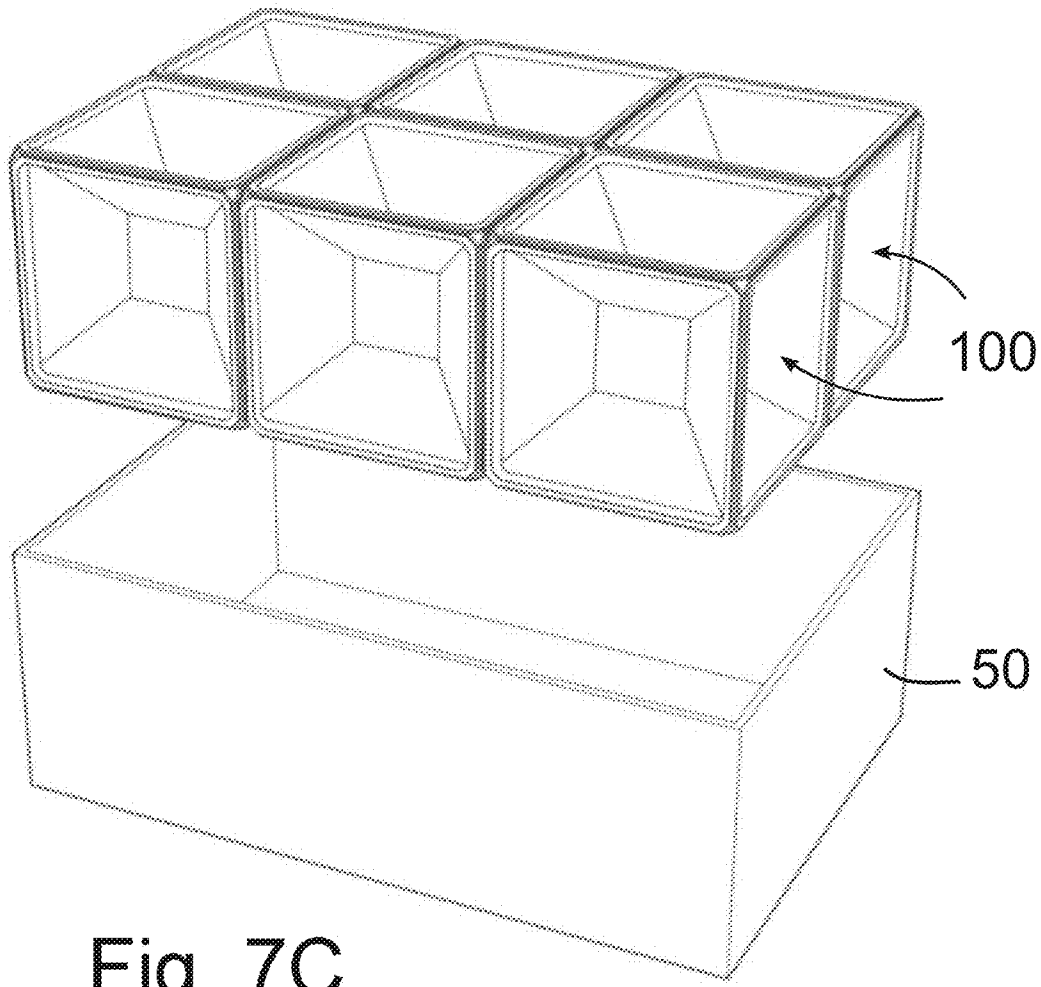
Figure 7D:
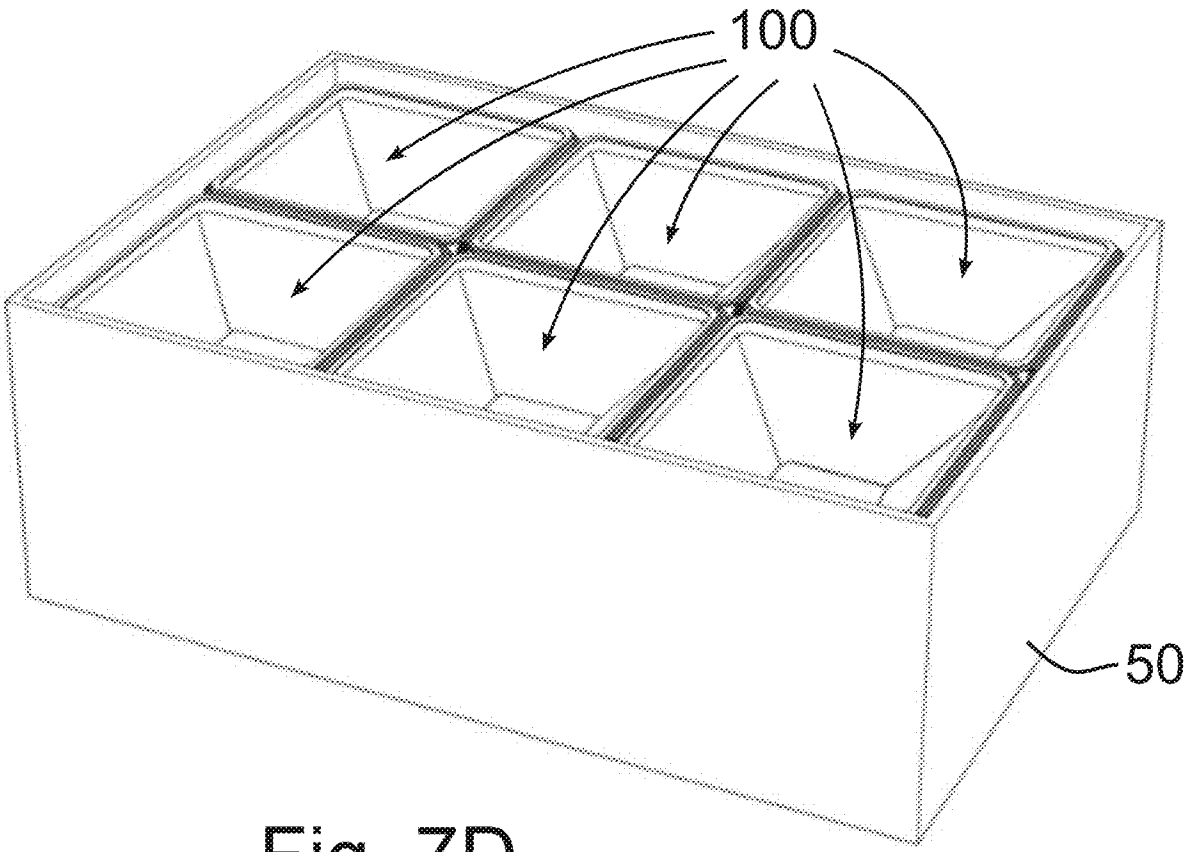

FIG. 3C shows a preassembled collection of a third embodiment of sub unit having a frustum FIG. 3D shows a preassembled collection of a first embodiment of sub unit FIG. 4A shows a partially assembled package unit from a collection of a first embodiment of sub unit with one sub unit removed FIG. 4B shows a partially assembled package unit from a collection of a third embodiment of sub unit with one sub unit removed and wherein the frusta form an inner volume FIG. 5 shows a partially assembled package unit having four sub units on each side FIG. 6 shows a reversed assembly FIG. 7A shows a preassembled collection of a third embodiment of sub units having a frustum as in FIG. 3C, about to get assembled FIG. 7B presents how a vertical force applied to a cube with 6 sub units having a frustum gets transferred to horizontal forces on the sub units FIG. 7C shows 6 cubes arranged to be put inside a housing FIG. 7D shows 6 cubes arranged inside a housing.

DESCRIPTION OF THE REFERENCE SIGNS

The following reference numbers and signs refer to the drawings:

| | |
|---|---|
| 10 | Packaging system according to prior art |
| 100 | Packaging system |
| 110 | Inner volume |
| 11, 112 | Lost volume or dead space |
| 200 | Sub unit |
| 12, 212 | Lid |
| 204 | Outer surface |
| 20, 300 | Body |
| 34, 304 | Sidewalls |
| 36, 306 | Partition wall |
| 37, 307 | End point |
| 38, 308 | Frustum, bottom face |
| 40, 310 | Enclosed volume |
| 42, 312 | Primary volume |
| 44, 314 | Secondary volume |
| 46, 316 | Primary content |
| 48, 318 | Secondary content |

DESCRIPTION OF PREFERRED EMBODIMENTS OF THE INVENTION

Principles Forming the Basis of the Invention

Figure 1:
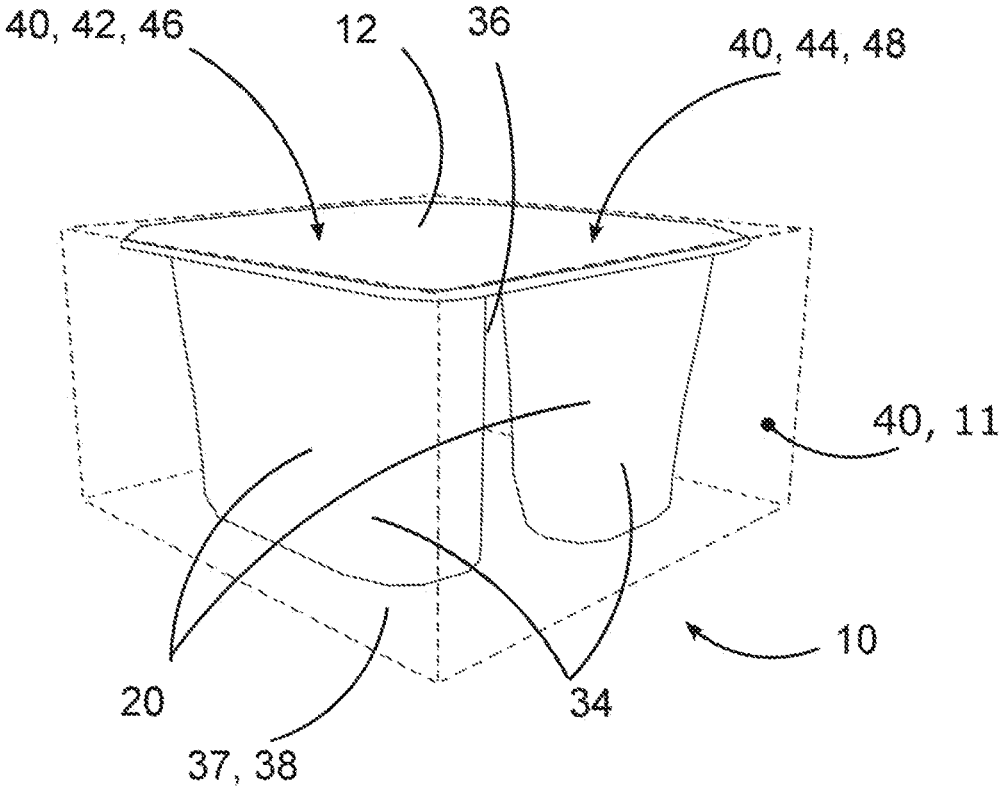
Fig. 1 PRIOR ART
FIG. 1 shows a packaging system according to prior art

FIG. 1 shows a typical packaging system 10 according to prior art, with a detachably attached lid 12 that when attached to a body having sidewalls 34 and a bottom face 38 forms a volume for holding contents 42. In some cases it is preferred to have separated contents in one unified packaging such as yoghurt and muesli. In such cases the body is also provided with a partition wall 36 that divides the enclosed volume 40 into two parts 42, 44.

However, when placing these in a cubic array a lot of lost volume or dead space 11 between the units is present. Also these are not suited to turn on the side as the shape does not lend itself to this.

Central to the present invention is the adaption of sub units to fit together forming a package system having little wasted space 112. Sub units 200 are formed with a tapered structure or body 300 having sidewalls 304 towards a narrow end 307, 308 from a first opposing or outer surface 204 at an end opposite the narrow end. Said sub units assembled with the narrow end inwards of the assembled packaging system. When assembled the first opposing surface forms the outer surface of the packaging system.

Best Modes of Carrying Out the Invention

In a preferred embodiment the sub units 200 are shaped like pyramids having a square lid 212 and a body 300 wherein the body has sidewalls 304 that taper towards an end. The end can be a point 307 like the peak of a pyramid or a frustum 308. The sidewalls 303 taper at an angle of about 45 degrees inwards. This means that four sub units can be placed together forming a periphery and two more perpendicular to these thus forming a packaging system 100.

This packaging system is a cube where the lids 212 form the outer surface. This has the advantage of providing a convenient surface for product or contents identification, no matter which direction the cube is placed on. Moreover the cube itself has very little dead space 112. Also cubes are well known to be stackable having little dead space between each cube.

The sub units can be formed in many ways.

Figure 2A:
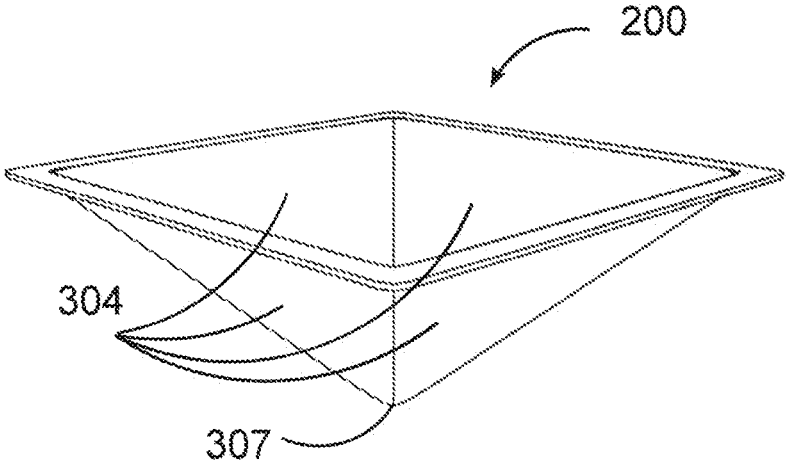
FIG. 2A shows a first embodiment of sub unit

FIG. 2A shows a second embodiment of sub unit in the form of a pyramid having an endpoint 307. The body 300 forms an enclosed volume 310 sealed with a detachable lid 212 holding contents.

Figure 2B:
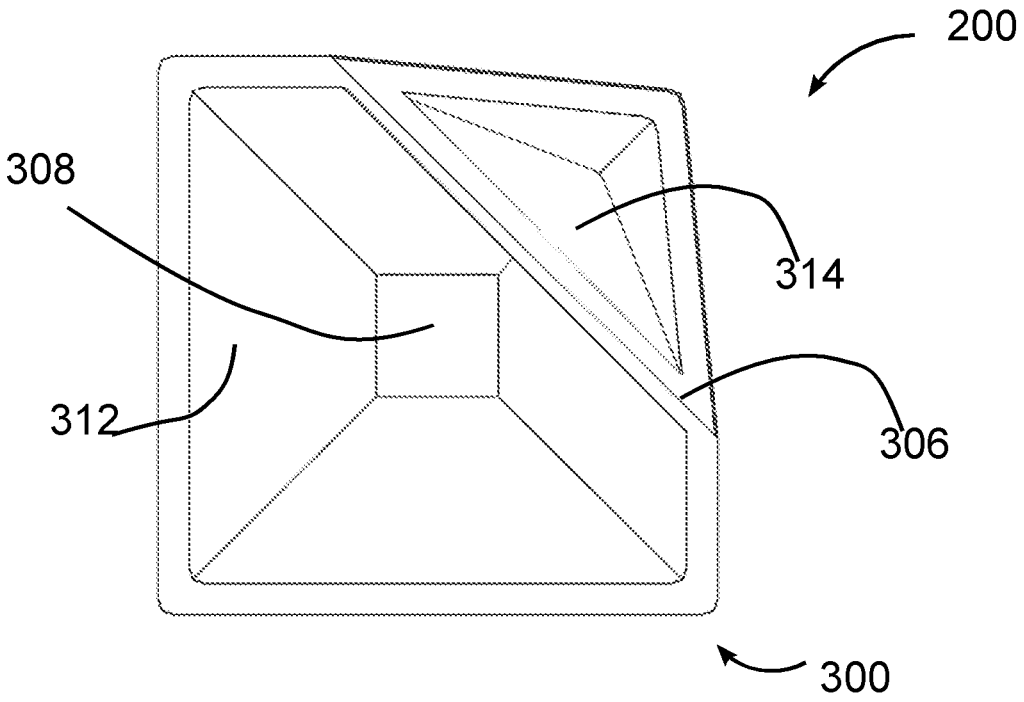
FIG. 2B shows a second embodiment of sub unit

FIG. 2B shows a first embodiment of sub unit in the form of a pyramid having a partition wall 306. The body 300 forms an enclosed volume 310 divided into a primary volume 312 and a secondary volume 314, both sealed with a detachable lid 212 holding contents. Preferably the lid seals in both volumes so that when detaching the lid both volumes are uncovered. More preferably the lid is directionally openable in order to uncover one volume at a time.

Figure 2C:
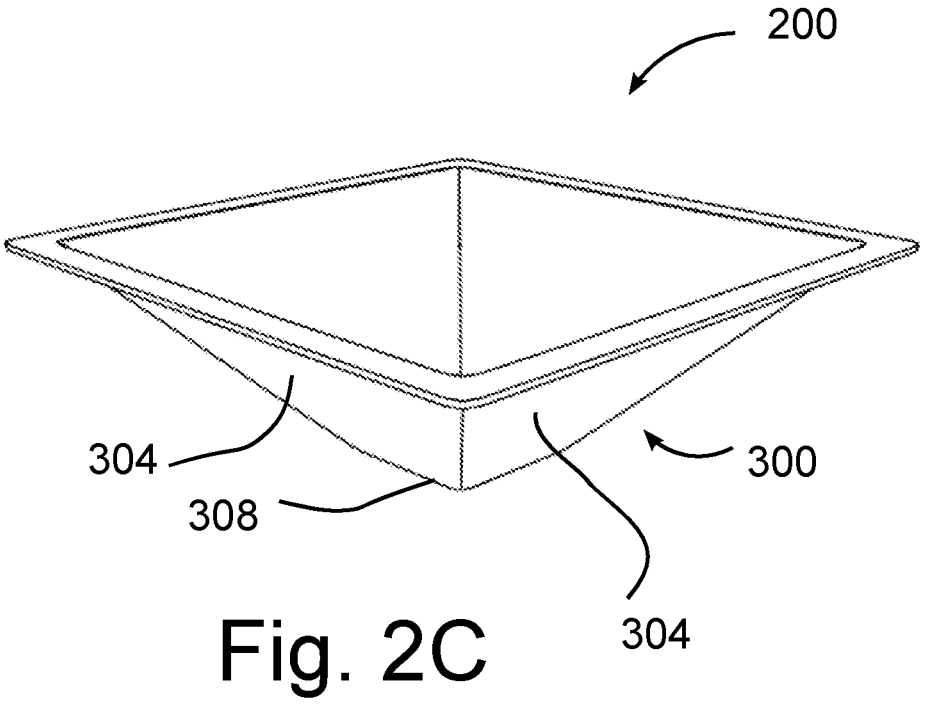
FIG. 2C shows a third embodiment of sub unit having a frustum
Figure 2D:
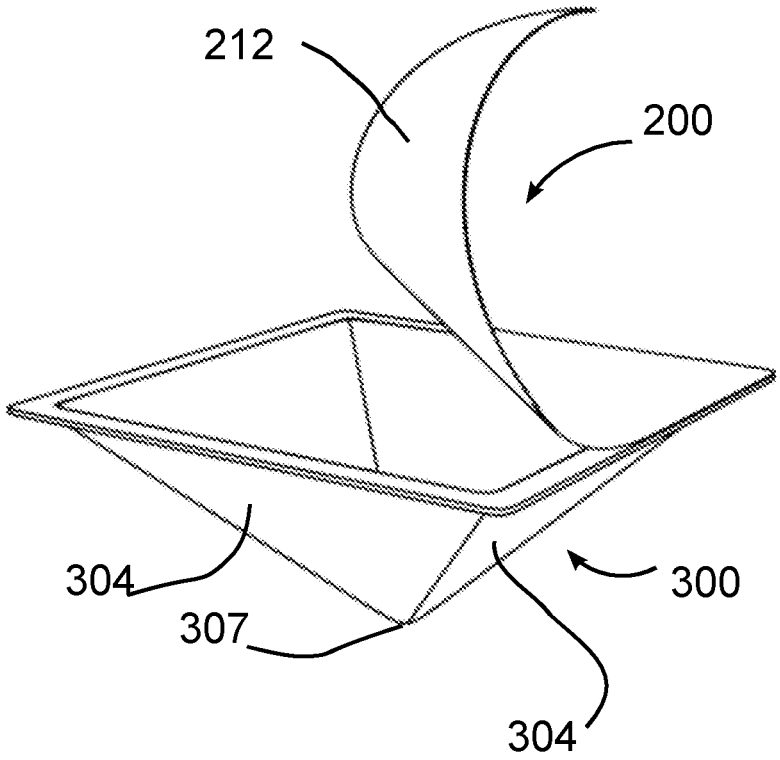
FIG. 2D shows the first embodiment of sub unit with a lid
Figure 2E:
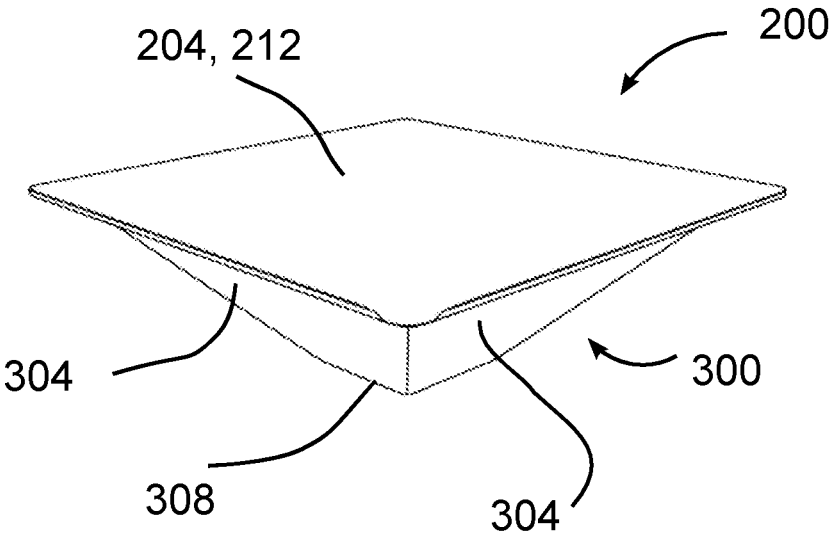
FIG. 2E shows the first embodiment of sub unit with the lid closed

FIG. 2C shows a third embodiment of sub unit in the form of a pyramid having a frustum 308. The body 300 forms an enclosed volume 310 sealed with a detachable lid 212 holding contents. The frustum provides a convenient foot for placing the sub unit on a flat surface such as a table. For liquid contents it is also easier to recover more of the contents for a sub unit having a frustum and more so if the transition between the sidewalls and the frustum is curved.

The sub units then will have to be assembled into a packaging system. There are at least 3 preferred embodiments for providing sub units for assembling. Some of these are pre assemblies wherein sub units are provided attached edge to edge in the same direction. Thus typically when the pre assembly is laid out all the bodies are facing up ready to be filled with contents and then closed with lids. The edge attachments can be cut to split one pre assembly into several smaller pre assemblies. In a more preferred embodiment the joints are bendably flexible, elastically and/or plastically, so that a pre assembly can be formed into an assembly system while minimizing cuts.

FIG. 3A shows a first embodiment each sub unit is detached and are freely selected to be assembled together into a packaging system. This provides full freedom in selecting different sub systems, lids and/or contents into one packaging system. The selection can be made at the very end of the process just before assembling. Such single units can be obtained by cutting off individual sub units from a roll of many sub units.

FIG. 3B shows a second embodiment wherein sub units are provided on strips or rolls of many sub systems joined together. Preferably the joints or attachments are detachable. On assembling four sub units are cut from the strip to form a ring, and two detached sub units are placed perpendicular to these thus forming a packaging system. As an alternative two strips of three sub units each are placed facing and perpendicularly together and slotted in together to form a packaging system.

FIG. 3C shows a third embodiment wherein all sub units are provided as a pre assembled collection wherein all sub units required to form a complete package system are attached together. In a preferred embodiment for a cubic packaging system the pre assembly comprises a strip of four sub units with further two sub systems wherein these are located on opposite sides of the longitudinal axis of the strip.

FIG. 4A shows a partially assembled package unit from a collection of a first embodiment of sub unit, illustrating how dead space is minimised.

FIG. 4B shows a partially assembled package unit from a collection of a third embodiment of sub unit wherein the frusta form an inner volume 110. This inner volume has many applications.

The inner volume can be used to contain a cooling element in order to maintain a low temperature for instance for perishable goods. In one example one can insert ice or dry ice. The cooling medium is typically a fluid such as water or $CO_2$ gas will flow along the inner surfaces of the sub units, keeping them cool.

Dry ice is particularly beneficial as the fluid is less affected by gravity and cools also the upper part of the package system well. On the other hand dry ice has a sublimation point of −78.5° C. which for some goods may require some thermal insulation between the dry ice and the sub units to avoid excessive freezing.

When using ice or other cooling media that forms a liquid it is beneficial to make the package system substantially water tight. If the packaging system is formed from a pre assembly the joints forming edges will easily be made water tight. Remaining edges can be made water tight using a sealant or by wrapping an outer layer around the packaging system. This wrapping can beneficially form the lids or labels on the lids on the individual sub units.

Alternatively the inner volume can be used for a heating element.

It is also beneficial to make at least one sub unit easily movable to uncover the inner volume in order to allow refilling cooling or heating medium at point of purchase.

The inner volume offers a position that is protected by the surrounding sub units and is therefore suitable for fragile objects.

When heating sub units on opposing sides can be detached leaving a tunnel like structure through which a fluid such as water or steam can be directed.

Condensation is very efficient in transferring heat to all exposed surfaces. A plurality of such tunnels can be stacked for more efficient heating.

Alternative Embodiments

For the case of the pyramidal embodiment shown in FIG. 2A one may conveniently use a frame for placing the sub unit on a table in order to provide further stability.

While a cubic shape for the packaging system is preferred it is clear that deviations from this are easily achieved. For instance the packaging system can easily be made squat or tall using rectangular sides wherein the sides are rectangles and the top and bottom faces are squares. Alternatively all faces can be rectangular non-squares.

In a further embodiment also higher order Platonic solid geometries can be used such as dodecahedrons. Also other isogonal geometries can be used even with different lids can be used such as truncated icosahedron having pentagonal and hexagonal lids.

While a single sub unit per face is disclosed above there are also alternative embodiments possible. FIG. 5 shows an embodiment wherein a plurality of sub units forms a single face.

Sub units can be filled with contents before sealing with lid and assembling into a packaging system. Alternatively it is possible to start with a pre formed packaging system and inject the contents through an opening and into the body. Preferably the pre formed packaging system comprises soft sidewalls for each sub units that are flat against the lid prior to filling. The side walls can in one embodiment be flexible or elastic and thus increase the volume of the body to accommodate the content. The opening can be provided on the lid or a part of the side wall.

During the filling process one can chose whether or not to have an inner volume, simply by inserting a suitable object inside the packaging system. The sidewalls will expand to enclose the object and secure it.

In one embodiment the packaging system is used for packaging fragile objects in the inner volume and the enclosed volumes of the sub units are filled with a fluid, more preferably a shock absorbing fluid.

In these embodiments much of the air between the sub units can be pressed out.

While the sidewalls could be vulnerable to mechanical damage said sidewalls will not be exposed to the outside. Instead the outer surface of the packaging system will provide the protection. Alternatively the sidewalls can be cured or a more robust material applied to the outside of the sidewalls to improve mechanical strength.

In many applications it is preferred to provide sub units with foil lids or other means for easy removal and thus access to the contents. Such foils can be fragile and easily punctured. It is in these cases possible to locate the foil lid on an inner surface of an assembled packaging system and use a more robust outer surface. This outer surface could optionally be made of the same material as the side walls.

Another preferred embodiment is a packaging system 100 where the substantial part of the outer surface e.g. the substantial part of sidewalls 304 and the lid 212 of each sub unit 200 mutually supports at least one, preferably at least two, most preferably at least four other sub units 200. FIG. 7B shows how a vertical force on one upper sub unit 200, indicated by a vertical open arrow, gets transferred to the remaining 5 sub units of a cube of 6 sub units 200, indicated by solid arrows. If a plurality of such cubes of sub units 200 is arranged inside a housing, such as indicated in FIGS. 7C and 7D, forces, generated from e.g. weight of sub units 200 and applied from above, are ultimately distributed to the walls of this housing. This mutual support, resulting in the sub units 200 being capable of withstanding considerable forces, is a fact if a substantial part of the total outer surface of the sub unit 200 is mutually supported. A substantial part of the total outer surface of the sub unit 200 is preferably intended to be more than 50%, more preferably more than 90% of the total outer surface of the sub unit 200. As is generally understandable, practical details in the design of edges and corners of the sub unit 200 will in many cases result in the fringes of the walls not getting being 100% support from mutual sub units 200. This is of little consequence as a substantial part of the forces are supported.

When stacking together systems of rectangular parallelepipeds, e.g. cubes, into a collection of parallelepipeds, e.g. collection of cubes, the outer boundaries of the collection may be positioned adjacent the inner walls of a housing.

The example housing of FIGS. 7C, 7D may contain any number of rectangular parallelepipeds, e.g. cubes in all three orthogonal axis.

The housing can be made of any material having tensile strength resisting stretching. In one preferred embodiment, the material may be cardboard. In another preferred embodiment the material may be plastic film.

FIG. 6 shows a reversed assembly, which is the assembly of sub units with end points pointing outwards rather than inwards. This can be assembled directly from strips as disclosed earlier, or by reversing the folding of a packaging system disclosed earlier. By assembling from strips, preferably long and continuous strips the packaging of pre assembled systems can be made very compact, and then assembled on demand and on site. Likewise this can be disassembled for reuse and transported in a very compact manner without the problems associated with expanded polystyrene.

The technical effect of this is that volume now is maximized rather than minimized as is the case for non-reversed packaging systems.

In one application, the packaging system 100 contains e.g. a meal. When this meal is consumed, the remaining waste, often occupying more volume than the meal itself, may be collected inside the packaging system 100, taking advantage of the fact that the reversed packaging system encloses a larger volume.

In another application of the reversed assembly, this can be used for lighting devices such as lamps. This can be transported as a packaging system, preferably with the more shock sensitive parts such as bulbs in the inner volume. On unpacking the sub units form the lamp shading.

In a second application this can be used for extra packaging protection known as an alternative to "packaging chips" or "foam peanuts" made of expanded polystyrene.

In the case of pre assembled sub units, as strips shown in FIG. 3B or as more complete assembled shown in FIG. 3C the sub units can be attached in many ways. In a first embodiment the sub units are attached by their bodies using the same material as in the bodies, preferably using living joints. This allows for production of continuous strips of sub units. Sub units can then easily be filled with contents and lids then sealing the contents in place before the sub units are cut to length and assembled into a packaging system.

In a second embodiment sub units are attached to each other using the lid, typically a foil. This allows for mix and match of various types of sub units, filling sub units with contents and then sealing the contents and simultaneously connecting said sub units using these lids. In a variation the sealing and connecting stages are separated, allowing freely ordering of sealing and connecting processes.

By these two embodiments, using a separate material for the sub units and the connecting parts between the sub units allows for transforming strips shown in FIG. 3B into more complete pre assemblies shown in FIG. 3C. Hybrid solutions with any combinations of separate subunits and pre-assembled sub units and attachments using lids or separate connecting stages in one packaging system is also possible.

INDUSTRIAL APPLICABILITY

The invention according to the application finds use in compact and robust packaging, transport and unpacking of goods.

The invention claimed is:

1. A packaging system comprising a plurality of sub-units and a housing with inner walls, the sub-units having a tapered structure towards a narrow end from a first opposing surface at an end opposite the narrow end, each of the sub-units being shaped as one of, a pyramid or as a frustum of a pyramid, wherein six stacked and detached sub-units are configured to be positioned so that they form a cube and so that first opposing surfaces of the sub-units form an outside of the cube, wherein a collection of cubes, which comprises a plurality of cubes and has outer boundaries, is stacked in the housing such that the outer boundaries of the collection of cubes is positioned adjacent the inner walls of the housing, and wherein the sub-units comprise side walls which mutually support each other force-wise when the collection of cubes is subjected to an external force.

2. The packaging system according to claim 1, wherein a substantial part of an outer surface of each sub-unit mutually supports at least four other sub-units, the substantial part of the outer surface of each sub-unit being more than 50% of the total outer surface of the sub-unit.

3. The packaging system according to claim 1, wherein a substantial part of an outer surface of each sub-unit mutually supports at least four other sub-units, the substantial part of the outer surface of each sub-unit being more than 90% of the total outer surface of the sub-unit.

4. The packaging system according to claim 1, wherein the side walls taper inwardly at 45 degrees.

5. The packaging system according to claim 1, wherein at least one of the sub-units comprises at least one partition wall, dividing a volume within the at least one of the sub-units into a plurality of volumes.

6. The packaging system according to claim 1, wherein the first opposing surfaces of the sub-units are provided with respective lids.

7. A packaging system comprising a plurality of sub-units and a housing with inner walls, the sub-units having a tapered structure towards a narrow end from a first opposing surface at an end opposite the narrow end, each of the sub-units being shaped as one of, a pyramid or as a frustum of a pyramid, wherein six stacked and detached sub-units are configured to be positioned so that they form a cube and so that first opposing surfaces of the sub-units form an outside of the cube, wherein a collection of cubes comprises a plurality of stacked cubes and has outer boundaries, and wherein the collection of cubes is stacked in the housing such that adjacent cubes in the collection have respective first opposing surfaces that abut each other, and the outer boundaries of the collection of cubes is positioned adjacent the inner walls of the housing and abutting the inner walls of the housing such that a force acting on a sub-unit is transferred to the other five sub-units of the cube and further to sub-units of adjacent cubes and further to the walls of the housing.

8. The packaging system according to claim 7, wherein the sub-units comprise side walls which mutually support each other force-wise when the collection of cubes is subjected to an external force.

9. The packaging system according to claim 7, wherein a substantial part of an outer surface of each sub-unit mutually supports at least four other sub-units, the substantial part of the outer surface of each sub-unit being more than 50% of the total outer surface of the sub-unit.

10. The packaging system according to claim 7, wherein a substantial part of an outer surface of each sub-unit mutually supports at least four other sub-units, the substantial part of the outer surface of each sub-unit being more than 90% of the total outer surface of the sub-unit.

11. The packaging system according to claim 7, wherein the sub-units comprise sidewalls which taper inwardly at 45 degrees.

12. The packaging system according to claim 7, wherein the first opposing surfaces of the sub-units are provided with respective lids.

13. A packaging system comprising a plurality of sub-units and a housing with inner walls, the sub-units having a tapered structure comprising four sidewalls extending from a first opposing surface towards a narrow end at an end opposite the first opposing surface, each of the sub-units being shaped as one of, a pyramid or as a frustum of a pyramid, wherein six stacked and detached sub-units are configured to be positioned so that they form a cube and so that the first opposing surfaces of the sub-units form an outside of the cube, wherein a collection of cubes, which comprises a plurality of stacked cubes and has outer boundaries, and wherein the collection of cubes is stacked in the housing such that adjacent cubes in the collection have respective first opposing surfaces that abut each other, and the outer boundaries of the collection of cubes is positioned adjacent the inner walls of the housing and abutting the inner walls of the housing such that a force acting on a sub-unit is transferred to the other five sub-units of the cube and further to sub-units of adjacent cubes and further to the walls of the housing.

14. The packaging system according to claim 13, wherein the sidewalls taper at an angle of about 45 degrees.

15. The packaging system according to claim 13, wherein the the sidewalls mutually support each other force-wise when the collection of cubes is subjected to an external force.

16. The packaging system according to claim 13, wherein a substantial part of an outer surface of each sub-unit mutually supports at least four other sub-units, the substantial part of the outer surface of each sub-unit being more than 50% of the total outer surface of the sub-unit.

17. The packaging system according to claim 13, wherein a substantial part of an outer surface of each sub-unit mutually supports at least four other sub-units, the substantial part of the outer surface of each sub-unit being more than 90% of the total outer surface of the sub-unit.

18. The packaging system according to claim 13, wherein the sidewalls taper inwardly at 45 degrees.

19. The packaging system according to claim 13, wherein the first opposing surfaces of the sub-units are provided with respective lids.

* * * * *